US007665519B2

(12) United States Patent
Oddie

(10) Patent No.: US 7,665,519 B2
(45) Date of Patent: Feb. 23, 2010

(54) SYSTEM AND METHOD FOR DOWNHOLE SAMPLING OR SENSING OF CLEAN SAMPLES OF COMPONENT FLUIDS OF A MULTI-FLUID MIXTURE

(75) Inventor: Gary Martin Oddie, St Neots (GB)

(73) Assignee: Schlumberger Technology Corporation, Cambridge, MA (US)

( * ) Notice: Subject to any disclaimer, the term of this patent is extended or adjusted under 35 U.S.C. 154(b) by 167 days.

(21) Appl. No.: 11/840,099

(22) Filed: Aug. 16, 2007

(65) Prior Publication Data

US 2008/0066908 A1 Mar. 20, 2008

(30) Foreign Application Priority Data

Sep. 19, 2006 (GB) ..... 0618404.8

(51) Int. Cl.
*E21B 49/08* (2006.01)
*E21B 27/00* (2006.01)

(52) U.S. Cl. ..... 166/264; 166/162; 166/72

(58) Field of Classification Search ..... 166/264, 166/162, 72, 265; 73/864.34, 152.18, 152.23, 73/152.28

See application file for complete search history.

(56) References Cited

U.S. PATENT DOCUMENTS

| | | | | |
|---|---|---|---|---|
| 3,530,711 | A | 9/1970 | Tocanne | |
| 3,721,121 | A | 3/1973 | Fiefort | |
| 5,237,878 | A * | 8/1993 | Hackenberg | 73/861.34 |
| 5,996,690 | A * | 12/1999 | Shaw et al. | 166/250.01 |
| 6,755,978 | B2 * | 6/2004 | Oddie | 210/747 |
| 6,923,259 | B2 * | 8/2005 | Snow | 166/265 |
| 7,255,167 | B2 * | 8/2007 | Cognata | 166/265 |
| 2004/0000433 | A1 * | 1/2004 | Hill et al. | 175/59 |
| 2006/0037746 | A1 * | 2/2006 | Wright et al. | 166/265 |
| 2006/0076132 | A1 * | 4/2006 | Nold et al. | 166/264 |
| 2007/0215348 | A1 * | 9/2007 | Corre et al. | 166/264 |
| 2008/0066538 | A1 * | 3/2008 | Kamiya et al. | 73/152.28 |

FOREIGN PATENT DOCUMENTS

| | | |
|---|---|---|
| GB | 2374620 | 11/2003 |
| GB | 2407109 | 4/2005 |

* cited by examiner

*Primary Examiner*—David J Bagnell
*Assistant Examiner*—James G Sayre
(74) *Attorney, Agent, or Firm*—James McAleenan; Jody DeStefanis; Helene Raybaud

(57) ABSTRACT

Embodiments of the present invention provide systems and methods for downhole sampling or sensing of clean samples of component fluids of a multi-fluid mixture. More specifically, but not by way of limitation, embodiments of the present invention provide for, amongst other things, separating downhole multi-fluid mixtures into an oil-based fluid, a water-based fluid and/or the like and sampling and/or sensing of the clean separated fluids. Such sampling or sensing may be provided by a downhole tool in accordance with some embodiments of the present invention and the downhole tool may be used for production logging, formation testing and/or the like.

19 Claims, 4 Drawing Sheets

SYSTEM AND METHOD FOR DOWNHOLE SAMPLING OR SENSING OF CLEAN SAMPLES OF COMPONENT FLUIDS OF A MULTI-FLUID MIXTURE

CROSS-REFERENCE TO RELATED APPLICATIONS

This application claims the benefits of priority from Application Number 0618404.8, entitled "SYSTEM AND METHOD FOR DOWNHOLE SAMPLING OR SENSING OF CLEAN SAMPLES OF COMPONENT FLUIDS OF A MULTI-FLUID MIXTURE," filed in the United Kingdom on Sep. 19, 2006, which is commonly assigned to assignee of the present invention and hereby incorporated by reference in its entirety.

BACKGROUND OF THE INVENTION

An issue associated with hydrocarbon recovery is that many oil producing wellbores or the like produce and earth formations surrounding such oil wells contain mixtures of fluids. Generally, such fluid mixtures may comprise a mixture of oil and/or gas, wherein the gas is often a gaseous hydrocarbon, together with water. Said mixtures may also contain reactive chemicals and may carry mineral particles, such as sand or the like. For purposes of hydrocarbon production, it is often necessary to collect samples of or test the fluids in the wellbore or the surrounding earth formations.

In hydrocarbon production from subsurface formations, it is often necessary to collect samples of or sense physical or chemical properties of fluids either downhole in the wellbore or in the formation or formations surrounding the wellbore. For example, when a wellbore is producing hydrocarbons a production logging tool may be introduced into the wellbore to either collect samples of and/or sense the physical or chemical properties of the fluids flowing downhole in the wellbore. In other situations, a wellbore tool may be equipped with a probe to provide for downhole withdrawing of fluids from earth formations surrounding the wellbore, such as collection of fluids from hydrocarbon reservoirs and the like. In yet other examples, fluids, aggregates, mud or the like may be pumped into the wellbore and/or the surrounding earth formations to provide for changing the interaction between the wellbore and the earth formation, changing the interaction between the wellbore and the hydrocarbon reservoir and/or the like and collection of samples and/or sensing of physical and chemical properties of fluids flowing in the wellbore or surrounding earth formations after such manufactured interaction changes have been initiated may be desirable.

Downhole collection or sensing of chemical and physical properties of fluids may be problematic because of fluid mixing (fluid mixtures may make accurate sensing of physical or chemical properties of the constituent fluids in the mixture inaccurate or in some circumstances impossible—presence of contaminants in the fluids to be collected and/or sensed—wherein the contaminants may be fouling contaminants, contaminants that may adversely affect sensors or the like. Furthermore, obtaining clean samples of constituent fluids of fluid mixtures downhole for sampling and/or sensing is problematic because of the physical dimensions of wellbore tools, sampling duration in dynamic wellbore conditions, adverse physical conditions, remoteness of the sampling site and/or the like.

In the first case, a knowledge of the hydrocarbon properties as a function of the position along the wellbore is useful in deciding the production strategy for the well and is presently carried out using an MDT. In this case, the fluid is drawn from the formation and passes sensors that analyze the fluids for contamination by drilling mud and water etc. After a period of time, the contamination decreases as the pumps draw fluid from deeper in the formation. Once the contamination is below a certain level, the fluid can then be diverted into a sampling chamber for bring back to the surface for more detailed analysis. It is extremely difficult to achieve zero contamination of the formation fluid sample by near wellbore invaded fluids and the wellbore fluid itself due to the nature of the flow in the formation and around the sampling probe. Existing sensors have to be sufficiently rugged to survive all possible fluid eventualities. To make real-time measurements of the fluid (hydrocarbon) properties requires low (ideally zero) levels of contamination of the wrong phase. The ability to control the phase species and quality will allow new sensors to be used in the downhole environment, and novel membrane based sensors will be expected to survive for longer periods of time than if they had to endure the full diversity of the mixed flow as it is extracted from the formation. Methods have been proposed to allow for aggregation of the mixed flow, so that slugs of the individual phases pass the sensors (Carnegie et al. 2003) and also the use of a hydrocyclone to achieve the separation and flow split (Oddie, 2002a and 2002b). In the first, the sensors still have to endure the diverse fluids and in the second, the pressure drop and the control of the fluid split would be problematic in the downhole environment.

Current production logging methods are aimed at determining the volumetric flow rates and spatial distribution of the fluids in the wellbore, as a function of position along the oil well. These measurements may be used to diagnose production problems in all types of completions—open hole, slotted liner, screened, cased and perforated etc. However, in more complex wells, such as those where the fluids are being produced from multiple zones or very thick producing layers, a detailed knowledge of the composition of the fluids as a function of position would be very useful. Identifying different qualities of hydrocarbons, for example, would allow specific interventions to produce what is desired, rather than waiting until the co-mingled flow arrives at the surface. Similarly identifying the composition of the water as a function of position would allow determination of shortcutting etc in waterflood wells, and those producing zones that are the sources of scale forming salts. Copositional analysis using PL tools would be a new service. The device proposed here would be extremely beneficial towards the quality of the results.

SUMMARY OF THE INVENTION

Embodiments of the present invention provide systems and methods for downhole sampling or sensing of clean samples of component fluids of a multi-fluid mixture. More specifically, but not by way of limitation, embodiments of the present invention provide for, amongst other things, separating downhole multi-fluid mixtures into an oil-based fluid, a water-based fluid and/or the like so that the separated oil-based fluid, the separated water-based fluid and/or the like may be sampled and/or sensed for physical and/or chemical properties. Such sampling or sensing may be provided by a downhole tool in accordance with some embodiments of the present invention and the downhole tool may be used for production logging, formation testing and/or the like.

In an embodiment of the present invention, a wellbore tool may be configured for disposal within a wellbore, the wellbore tool may include a sampling conduit that is configured to provide a flow path for sampling fluids down the wellbore, wherein the sampling conduit comprises one or more apertures in a sidewall of the sampling conduit, and a settling chamber may be coupled with the sampling conduit and may provide that at least a part of the sample of the downhole fluids flowing in the sampling conduit flows through the one or more apertures and into the settling chamber, so that the fluids collected in the settling chamber may separate under gravity.

In aspects of the present invention, a first sample outlet conduit may be coupled with the settling chamber and configured to provide for flowing one of the first or the second fluids out of said settling chamber. After having been separated by gravity the first or the second fluids may be clean samples and, in certain aspects, these clean samples may be interacted with one or more sensors to determine chemical or physical properties of such clean samples. In certain aspects, a proportion of the one or more clean samples of the constituent fluids may be collected for removal from the wellbore. In such aspects, the collection of a proportion of the clean samples may be performed after a sensor has sensed the sample to determine whether the fluid emerging from the settling chamber is a clean sample.

In some embodiments of the present invention, the wellbore fluids sampled may be fluids in the wellbore. In certain aspects, the wellbore tool may be a logging tool and the logging tool embodying the present invention may be used to collect samples of or sense physical or chemical properties of fluids being produced by the wellbore, i.e., the logging tool being used for what is known as production logging. In other embodiments, the wellbore tool including an embodiment of the present invention for collecting or sensing clean samples of fluids downhole may be configured for obtaining fluids from the earth formations proximal to the wellbore, i.e. for reservoir characterization and the like. In such embodiments for collecting or sensing reservoir fluids from an earth formation the wellbore tool may comprise a probe, such as a guarded probe or the like, configured to withdraw fluids from the earth formation adjacent to the wellbore. In other aspects, the wellbore tool may be used during other wellbore processes associated with hydrocarbon recovery from the wellbore.

In certain embodiments of the present invention, the sampling conduit may be configured to provide for selective sampling of the downhole fluids. In certain aspects, the sampling conduit may be positioned relative to the wellbore and/or the wellbore tool to provide for sampling of lower density or higher density fluids. In some aspects, the sampling conduit may be connected to a mechanism to provide that whatever the orientation of the wellbore tool the sampling conduit is positioned for selectively receiving fluids with certain density properties. Similarly, outlet conduits from the settling chamber may also be fitted with mechanisms to provide for selective outflow through the outlet channel of separated fluids with certain density characteristics. Such mechanisms may include weights, floats, gravitational orientation mechanisms, computer controlled mechanisms and/or the like. Furthermore, in an embodiment of the present invention a variable blockage mechanism, such as a valve or the like, may be used to control differential pressure of the fluids flowing through the wellbore tool to provide, among other things, for driving fluid samples through or into contact with a sensor and/or into a sample collection receptacle.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The invention will be better understood in the light of the following description of non-limiting and illustrative embodiments, given with reference to the accompanying drawings, in which.

DETAILED DESCRIPTION OF THE INVENTION

Embodiments of the present invention provide systems and methods for downhole sampling or sensing of clean samples of component fluids of a multi-fluid mixture. More specifically, but not by way of limitation, embodiments of the present invention provide for, amongst other things, separating downhole multi-fluid mixtures into an oil-based fluid, a water-based fluid and/or the like so the oil-based fluid, a water-based fluid and/or the like and sampling and/or sensing of the separated fluids. Such sampling or sensing may be provided by a downhole tool in accordance with some embodiments of the present invention and the downhole tool may be used for production logging, formation testing and/or the like.

Figure 1:
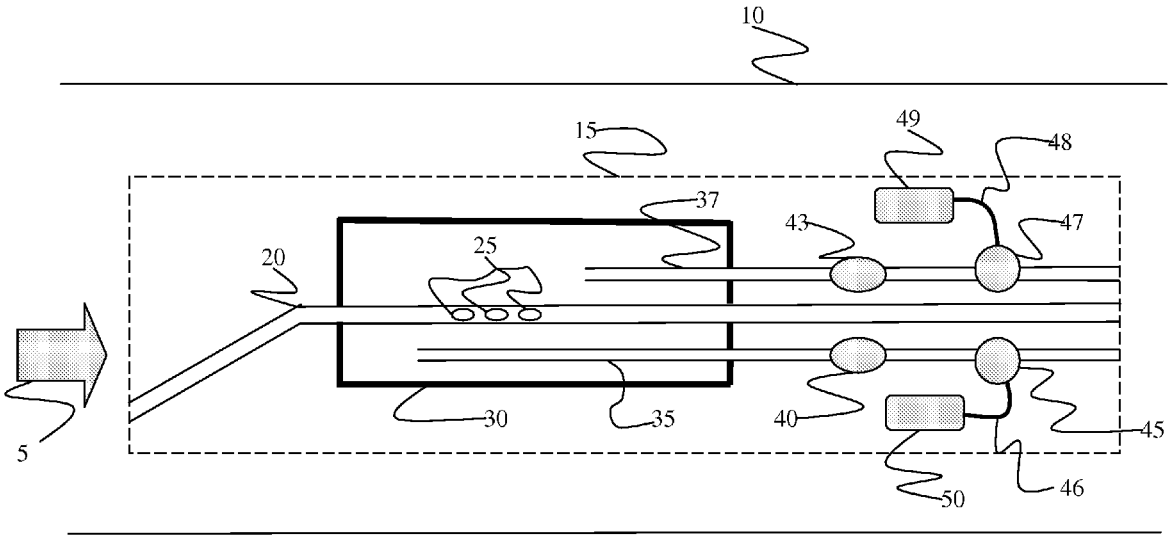
FIG. 1 provides a schematic-type representation of a wellbore tool for operating downhole to collect and/or sense properties of a clean sample of constituent fluids of a fluid mixture, in accordance with an embodiment of the present invention.

FIG. 1 provides a schematic-type representation of a wellbore tool for operating downhole to collect and/or sense properties of a clean sample of constituent fluids of a fluid mixture, in accordance with an embodiment of the present invention. In hydrocarbon production from subsurface formations, it is often necessary to collect samples of or sense physical or chemical properties of fluids either downhole in the wellbore or in the formation or formations surrounding the wellbore. For example, when a wellbore is producing hydrocarbons a production logging tool may be introduced into the wellbore to either collect samples of and/or sense the physical or chemical properties of the fluids flowing downhole in the wellbore. In other situations, a wellbore tool may be equipped with a probe to provide for downhole withdrawing of fluids from earth formations surrounding the wellbore, such as collection of fluids from hydrocarbon reservoirs and the like. In yet other examples, fluids, aggregates, mud or the like may be pumped into the wellbore and/or the surrounding earth formations to provide for changing the interaction between the wellbore and the earth formation, changing the interaction between the wellbore and the hydrocarbon reservoir and/or the like and collection of samples and/or sensing of physical and chemical properties of fluids flowing in the wellbore or surrounding earth formations after such manufactured interaction changes have been initiated may be desirable.

Downhole collection or sensing of chemical and physical properties of fluids may be problematic because of fluid mixing (fluid mixtures may make accurate sensing of physical or chemical properties of the constituent fluids in the mixture inaccurate or in some circumstances impossible—presence of contaminants in the fluids to be collected and/or sensed—wherein the contaminants may be fouling contaminants, contaminants that may adversely affect sensors or the like. Furthermore, obtaining clean samples of constituent fluids of fluid mixtures downhole for sampling and/or sensing is problematic because of the physical dimensions of wellbore tools, sampling duration in dynamic wellbore conditions, adverse physical conditions, remoteness of the sampling site and/or the like.

As depicted in FIG. 1, a mixture of fluids 5 may be flowing downhole in a wellbore 10. In an embodiment of the present invention, a wellbore tool 15 may be deployed in the wellbore 10 to provide for downhole sampling/testing of the mixture of fluids 5. The wellbore tool 15 may comprise a sampling conduit 20 for obtaining a portion of the mixture of fluids 5.

In FIG. 1, the mixture of fluids 5 is flowing in a certain orientation in the wellbore. However, in certain circumstances the mixture of fluids 5 may be static in the wellbore, flowing in one or more directions or may be disposed in an earth formation adjacent to the wellbore 10. As such, the wellbore tool 15 may include a pump, flow controller or the like (not shown) for flowing the mixture of fluids 5 into the sampling conduit 20. In other aspects of the present invention, the wellbore tool 15 may be configured with a probe for contacting/penetrating a sidewall of the wellbore 10 to provide for withdrawing of fluids from the earth formation surrounding the wellbore into the wellbore tool 15. A mixing device (not shown) may be disposed in the wellbore tool 15 or adjacent to the wellbore tool 15 upstream of the sampling conduit 20 to provide that the sampling conduit 20 may receive a homogenous sample of the mixture of fluids 5. In some aspects of the present invention, the sampling conduit 20 may be positioned on the wellbore tool 15 to provide for obtaining a sample of the mixture of fluids 5 from a certain location in the wellbore 10. For example, the sampling conduit 20 may be configured to collect fluids close to or at the sidewall of the wellbore 10, from the center of the wellbore 10 or the like. As such, as persons of skill in the art may appreciate, the sampling conduit 20 may be configured to selectively collect fluids flowing in the wellbore 10.

In an embodiment of the present invention, the sampling conduit 20 may contain one or more apertures 25 through which a portion of the mixture of fluids 5 flowing in the sampling conduit 20 may flow into a settling chamber 30. In certain aspects, the dimensions, positioning and/or the like of the apertures 25 may be selected to provide that the mixture of fluids 5 flowing into the settling chamber 30 causes minimal disturbance to fluids already disposed within the settling chamber 30. Baffles, fluid diverters and/or the like may also be used to minimize disturbance of the fluids in the settling chamber 30 by the inflowing fluids. In certain embodiments of the present invention, the dimensions of the one or more apertures 25 may be of the order of millimeters. In certain aspects, the portion of the mixture of fluids 5 that does not flow into the settling chamber 30 may continue to flow through the sampling conduit 20 and out of the wellbore tool 15. In other aspects, additional settling chambers associated with additional apertures may be disposed along the sampling conduit 20 to provide for the collection and separation of additional portions of the mixture of fluids 5. In certain aspects, the settling chamber 30 may be approximately cylindrical and may surround the sampling conduit 20, in such a way that the main axis of said settling chamber 30 and the main axis of the sampling conduit 20 are the same. The wall of the producing pipe 3 is provided with at least one but, preferably, a plurality of small apertures 18.

After flowing into the settling chamber 30, the mixture of fluids 5 may be separated by gravitational effects into one or more component fluids. The component fluids may be oil-based fluids, water-based fluids and/or the like. Further, gravitational effects may provide for separation of contaminants from the oil-based fluids and/or water-based fluids. If properties of contaminants are known, barriers, filters and/or the like may be configured with the settling chamber 30 to provide for removal of the contaminants from the oil-based fluids and/or water-based fluids. In some aspects of the present invention, the settling chamber 30 may have dimensions of the order of 10 s of millimeters. In other aspects, the settling chamber 30 may have dimensions of the order of centimeters or greater to provide a large area for separation and manipulation of the fluid components of the mixture of fluids 5. In accordance with one embodiment of the present invention, gravitational separation of the mixture of fluids 5 in the settling chamber 30 may be effectively achieved in a matter of 10 s of seconds. In other aspects of the present invention, longer gravitational separation durations may be employed to provide for a more complete separation of the mixture of fluids 5 into constituent fluids.

In an embodiment of the present invention, a sample outflow conduit 35 may be provided so that a constituent fluid of the mixture of fluids 5 that has separated under effects of gravity in the settling chamber 30 may flow out of the settling chamber 30. As depicted a second sample outflow conduit 37 may be provided to allow for outflow of two constituent fluids of the mixture of fluids 5 from the settling chamber 30. Location of the sample outflow conduit 35 relative to the bottom of the settling chamber 30 may be used to select a relative density of the constituent fluid of the mixture of fluids 5 flowing through the sample outflow conduit 35. Merely by way of example, the sample outflow conduit 35 may be disposed close to the bottom of the settling chamber 30 and may provide for outflow through the sample outflow conduit 35 of a water-based fluid constituent of the mixture of fluids 5. In contrast, the sample outflow conduit 35 may be disposed towards a top of the settling chamber 30 and may provide for outflow through the sample outflow conduit 35 of an oil-based fluid constituent of the mixture of fluids 5.

As depicted in FIG. 1, the sample outflow conduit 35 may be located at a location below a median of the depth of the settling chamber 30 and the second sample outflow conduit 37 may be disposed above the sample outflow conduit 35 and this configuration may provide for selective flow of higher density constituent fluids of the mixture of fluids 5 through the sample outflow conduit 35 and flow of lower density constituent fluids of the mixture of fluids 5 through the second sample outflow conduit 37. Merely by way of example, such an arrangement may provide for selective flow of an oil-based constituent fluid of the mixture of fluids 5 through the second sample outflow conduit 37 and a selective flow of a water-based constituent fluid of the mixture of fluids 5 through the sample outflow conduit 35. As persons of skill in the art may appreciate, different configurations of the outflow conduit(s) and the settling chamber 30 may provide for selective withdrawal of constituent fluids of the mixture of fluids 5.

Separation occurring in an apparatus according to the present invention, provided with a settling chamber 30 comprising only one or two sample outflow conduits 35, may be sensitive to its orientation around its central axis. As such, by fixing three or more of the sample outflow conduit 35 around the circumference of the settling chamber 30 regularly spaced around the circumference of the settling chamber 30, separation may occur whatever the position of the apparatus around the central of the apparatus. In such a configuration, there may always be one of the sample outflow conduit 35 close to the bottom of the settling chamber 30 that may allow for the evacuation of the densest separated fluid.

Each exit sample outflow conduit 35 may be connected to the lower part of the settling chamber 30. In some embodiments, there may be three sample outflow conduits 35 which are each connected to the lower part of the settling chamber 30 at connection points spaced at 120° along the circumference of said settling chamber 30. Each sample outflow conduit 35 may comprise a flow restriction valve to control the flow of the fluids out of the settling chamber 30 and may also be equipped with a non-return valve to prevent backflow of fluids through the sample outflow conduit 35 into the settling chamber 30. The sampling conduit 20 may also be provided with a flow-controlling valve to control the sampling process and the flow of the flow of the fluid mixture 5 through the wellbore tool 15.

The wellbore 10 or the formation surrounding the wellbore 10 may contain a mixture of immiscible fluids, said mixture may comprise at least two different fluids, and the fluids may carry some particles, such as sand or the like. The density of said first fluid may be greater than the density of said second fluid. For example, the first fluid may be water-based, that is to say comprising essentially water and may be some other compounds, such as mineral salts or the like, and the second fluid may be oil-based, that is to say comprising essentially hydrocarbons. However, any mixture comprising at least two fluids of a different density may be the object of the system of the present invention.

When the flow controlling valves in the sample outflow conduit 35 are closed, the mixture stagnates in the settling chamber 30, oil droplets coalesce and, over a period of time, water separates from the mixture under gravity. As a result of the separation process, the lower portion of the settling chamber 30 fills with the denser fluid of the mixture, that is to say the water-based fluid, whereas the upper part of said chamber fills with the lighter fluid of the mixture, that is to say the oil-based fluid. The area within the settling chamber 30 close to the apertures 25 may receives small fluid fluctuations, depending on the level of mixing of the mixture flowing in the sampling conduit 20 or the wellbore. However, within the settling chamber 30, away from the apertures 25, the flow is almost stationary. If an outlet conduit is provided on the lower side of the settling chamber 30 with an opened valve, water-based fluid may flow out of this outlet conduit and, in particular, when the apparatus is not horizontal, a non-return valve in such a conduit may prevent back flow into the settling chamber 30. With such outflow, the fluid mixture 5, coming from the sampling conduit 20, may replenish the settling chamber 30 for further fluid separation. Where sand is carried in the mixture of fluids 5, it may fill the lower portion of the settling chamber 30. An exit pipe may be provided in the settling chamber 30 to provide for removal of such sand. In certain aspects, the settling chamber 30 may be configured to provide for back-washing to remove substances from the settling chamber 30 that are not flowing out of the outlet conduits so that the sampling/sensing device may be cleaned during deployment downhole.

For a given quality of separation, an extraction flow rate, i.e. the flow rate of the fluid mixture 5 through the wellbore tool 15, may depend on the droplet size distribution within the mixture flow, the pipe deviation, the difference of density between the fluids and on factors that determine the rate of coalescence in the settling chamber 30. However, an optimum extraction flow rate may be determined experimentally, by adjusting the flow rate through the system to the point just before the mixed flow has not had a sufficient residence time in said chamber to separate to a required quality. Then, it is possible to allow flow restriction valves to be preset in the sample outflow conduit 35 to establish an equilibrium flow that provides continuous separation through the settling chamber 30.

If the quality of the separated flow is not considered adequate for the subsequent sensing and/or sampling, then embodiments of this invention, could be used as an inlet flow to a further separation processes such as a hydrocyclone, where the combined performance would be greatly improved. In this case, the operating envelope of a hydrocyclone could be considerably increased. The separation process of the present invention may therefore be combined with any other process to improve the performance of the separation prior to passing a clean sample to a sensor or collecting a sampling receptacle.

The fluid flowing in the sample outflow conduit 35 may be contacted with or flowed past/through a sensor 40. The sensor 40 may be an optical fluid analyzer, a flow meter, a pressure sensor, a viscosity sensor, a temperature sensor, a microwave sensor, a radiation count sensor, a venturi, a combination of such sensors or meters or any other kind of sensor capable of sensing physical and/or chemical properties of the fluid flowing in the sample outflow conduit 35. Similarly, a second sensor 43 may be positioned to measure physical and/or chemical properties of the fluid flowing in the second sample outflow conduit 37.

In some embodiments of the present invention, a separator 45 may be configured to flow a portion of the fluid flowing in the sample outflow conduit 35 through a separation conduit 46 into a sample receptacle 50. In this way, a sample of the fluid flowing through the sample outflow conduit 35 may be collected. The separator 45 may comprise one or more valves or the like and may be controlled by a processor or the like (not shown). As depicted in FIG. 1, a second diverter 47 may be configured with the second sample outflow conduit 37 to divert the fluid flowing through the second sample outflow conduit 37 through a second separation conduit 48 and into a second sample receptacle 49.

In embodiments of the present invention comprising both the sensor 45 and the sampling system, the sensor 45 may be used to determine when a sample of the fluid flowing in the sample outflow conduit 35 is collected in the sample receptacle 50. In this way, the sampling process may be managed. This management of the sampling process may provide, among other things, that samples may be collected in the sample receptacle 50 when the sensor 40 has sensed that gravitational separation of the mixture of fluids 5 in the settling chamber 30 has provided an essentially clean fluid flowing in the sample outflow conduit 35.

In certain aspects of the present invention, sensors or sample receptacles may be configured with the sampling conduit 20 to provide for collection of samples of or sensing of properties of the mixture of fluids 5 that is not processed in the settling chamber 30. In such aspects, samples collected in the sample receptacle 50 or physical or chemical properties of the fluid flowing in the sample outflow conduit 35 may be compared to the non-gravitationally separated mixture of fluids 5 flowing in the sampling conduit 20. This comparison may provide for determining when clean samples of constituent fluids of the mixture of fluids 5 are flowing in the sampling conduit 20, determination of differences between the constituent fluids and the mixture of fluids 5 and/or the like.

In certain aspects, through-flow of mixed fluid passes down the sampling conduit 20 and is discarded from the process. The holes/apertures in the sampling conduit 20 allow a continuous interchange of the fluids in the sampling conduit 20 and the settling chamber 30. The flow through the holes may be gentle, so the velocity/turbulence of the flow in the sampling conduit 20 does not stir up the fluids in the settling chamber 30.

In experimentation with an embodiment of the present invention, it was determined that by appropriately positioning the sampling tube in the wellbore, a flow with a water cut of 50% (i.e. the oil holdup may be anywhere from 50% to 20% in realistic flowing wells), a sample of water with an oil concentration of 100 ppm can be gathered in 40 seconds. Shorter residence times result in higher concentrations of contaminants.

The flow through the sampler can be driven by a pump, as in the case of formation sampling, such as with the Modular Formation Dynamics Tester™ where the fluids are being drawn from the formation, or in production logging where a pump can be built into the hydraulic system, or in the case of production logging where the pressure drop of the main flow over the tool body can be used to drive the flow through the sampling chamber and past the sensors.

Figure 2:
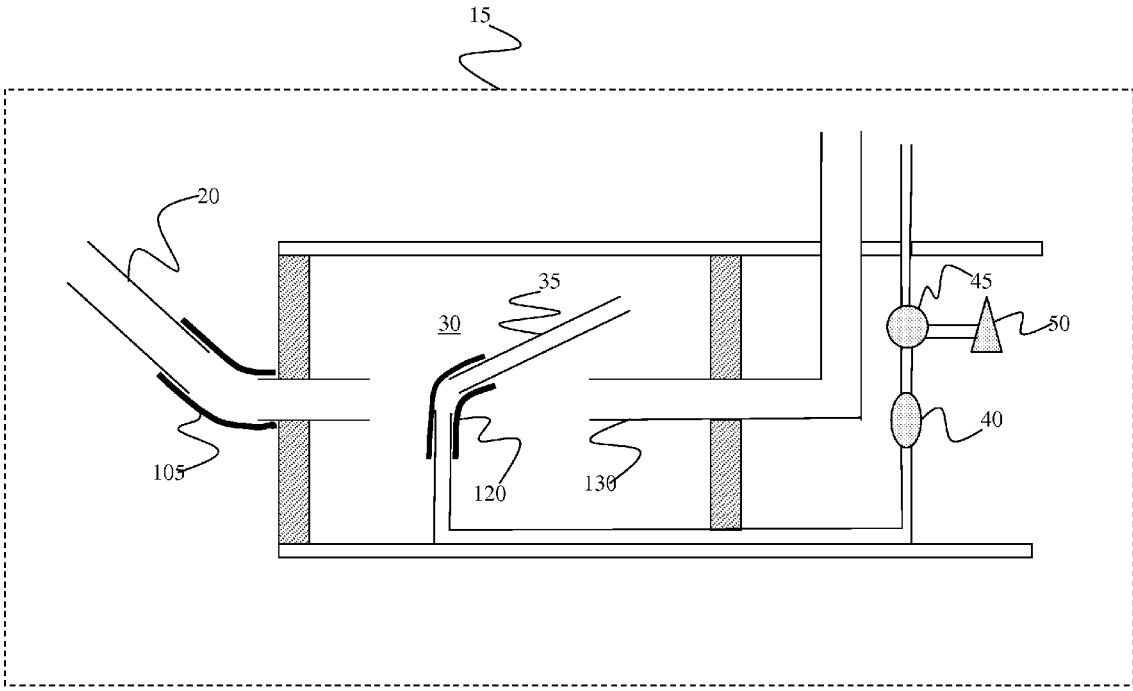
FIG. 2 provides a schematic-type representation of a wellbore tool for operating downhole to collect and/or sense properties of a clean sample of constituent fluids of a fluid mixture wherein a sampling conduit and or a sample outlet conduit may be maneuverable to provide for selective sampling and/or selective sample outflow, in accordance with an embodiment of the present invention.

FIG. 2 provides a schematic-type representation of a wellbore tool for operating downhole to collect and/or sense properties of a clean sample of constituent fluids of a fluid mixture wherein a sampling conduit and or a sample outlet conduit may be maneuverable to provide for selective sampling and/or selective sample outflow, in accordance with an embodiment of the present invention. In certain aspects, the wellbore tool 15 may be configured to sample downhole fluids from a certain location in the wellbore. As previously detailed, the wellbore tool 15 may be provided with a probe, which may be a guarded probe, to provide for sampling of formation fluids. In such formation fluid sampling, the operation of an embodiments of the present invention after the formation fluid has been provided to the sampling conduit or its equivalent may be the same as when fluids in the wellbore are sampled by the wellbore tool 15. In the sampling of the formation fluids, different types of probes may provide for selection of formation fluids to be sampled.

To provide for collection of downhole fluids from certain locations in the wellbore, in certain aspects of the present invention, the sampling conduit 20 may be coupled to the settling chamber 30 by a flexible connector 105. In this way, an orientation of the sampling conduit 20 relative to the settling chamber 30 and/or the wellbore tool 15 may be set so that the sampling probe may collect fluids from the sidewall of the wellbore, the center of the wellbore or locations between these extremes. Such orientation of the sampling conduit 20 may be important when a mixer is not used upstream of the sampling conduit 20. In such situations, the wellbore fluids may preferentially flow along the sidewall of the wellbore and the center portion of the wellbore may contain gaseous hydrocarbons or the like. Consequently, to obtain samples of the wellbore fluids the sampling conduit 20 may be oriented with respect to the wellbore tool 15 such that when the wellbore tool 15 is deployed in the wellbore the sampling conduit 20 is disposed with an opening close to the sidewall of the wellbore. Positioning of the sampling conduit 20 in the conduit may be set by an operator at the surface prior to deployment of the wellbore tool 15 or the sampling conduit 20 may be configured to be actively controlled during the deployment of the wellbore tool 15 so that its location in the wellbore may be actively managed.

In certain embodiments of the present invention, the sample outflow conduit 35 may be coupled with a flexible outflow connector 110 so that the position of the opening of the sample outflow conduit 35 may be altered within the settling chamber 30. In this way, a desired position of the opening of the sample outflow conduit 35 may be set prior to deployment of the wellbore tool 15 or actively managed during the sampling process so that the constituent fluid of the fluid mixture entering the settling chamber 30 that flows out through the sample outflow conduit 35 may be adjusted. Merely by way of example, as depicted in FIG. 2, the opening of the sample outflow conduit 35 may be positioned towards the top of the settling chamber 30 so that when a fluid mixture containing water-based and oil-based fluids enters the settling chamber 30, the oil-based fluid is selectively flowed through the sample outflow conduit 35. In such an example, the water-based fluid will flow through the outlet conduit 130. A processor or the like may be used to actively manage the downhole sampling/sensing of different constituent fluids of the fluid mixture when the wellbore tool 15 is deployed in the wellbore.

As described above, the sensor 40, the diverter 45 and/or the sample receptacle 50 may be used in conjunction with the sample outflow conduit 35 to sample and/or sense chemical and or physical properties of the selected constituent fluid flowing out of the settling chamber 30 through the sample outflow conduit 35. In the depicted embodiment, the fluid mixture may flow into the settling chamber 30 through the sampling conduit 20. In other aspects, the fluid mixture may flow into the settling chamber 30 through apertures or the like in the sampling conduit 20.

Figure 3:
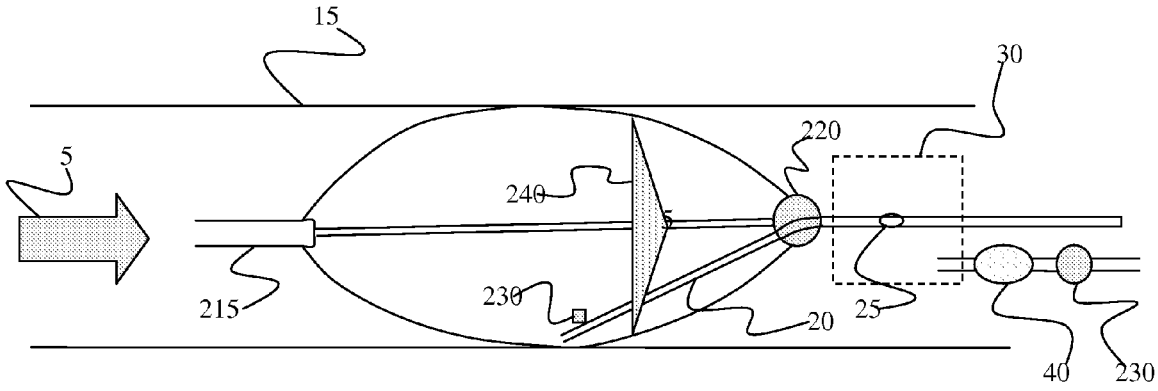
FIG. 3 is a schematic-type representation of a wellbore tool for operating downhole to collect and/or sense properties of a clean sample of constituent fluids of a fluid mixture wherein a sampling conduit may be configured for selective sampling of fluids independent of wellbore tool orientation and flow of clean samples to a sensor or sampling receptacle may be controlled by a pressure differential control device, in accordance with an embodiment of the present invention.

FIG. 3 is a schematic-type representation of a wellbore tool for operating downhole to collect and/or sense properties of a clean sample of constituent fluids of a fluid mixture wherein a sampling conduit may be configured for selective sampling of fluids independent of wellbore tool orientation and flow of clean samples to a sensor or sampling receptacle may be controlled by a pressure differential control device, in accordance with an embodiment of the present invention. In such an embodiment of the present invention, the wellbore tool 15 may comprise a centralizer 210 with a concentric main bus 215.

The fluid mixture 5 may flow or be drawn into the wellbore tool 15. As persons of skill in the art may appreciate, the orientation of the wellbore tool 15 and the associated system relative to the wellbore etc may not be known. As such, prearranging the position of the sampling conduit 20 may not be possible. However, in certain aspects the sampling conduit 20 may be connected to a ball joint 220 or the like that may provide for movement of the sampling conduit 20 during deployment of the wellbore tool 15 in the wellbore. A weight 230, or a counterweight system or the like, may be attached to the sampling conduit 20 to provide that whatever the orientation of the wellbore tool 15 in the wellbore the sampling conduit 20 will maintain essentially the same orientation with respect to the wellbore. The centralizer 210 and/or associated mechanical stops may provide a range of positions the sampling conduit 20 may take with respect to the wellbore tool and the wellbore. For example, the mechanical stops may fix a maximum movement of the sampling conduit 20 in the wellbore tool 15. In other aspects, a processor may receive information about the wellbore tool 15 and its orientation in the wellbore and may manage the position of the opening of the sampling conduit 20 relative to the wellbore.

After actively controlling the position of the sampling conduit 20, the fluid mixture 5 received by the sampling conduit 20 under the desired orientation of the sampling conduit 20 may be flowed through the apertures 25 into the settling chamber 30. A separated constituent fluid may be flowed out of the settling chamber 30 through the sample outflow conduit 35 and may be collected in a sample receptacle 230 and/or the physical or chemical properties of the constituent fluid may be sensed by the sensor 40. In certain aspects, the sample outflow conduit 35 may be configured in the same manner as the sampling conduit 20 to provide that it too may sample the same constituent fluid whatever the orientation of the wellbore tool 15.

A variable blockage device 240, which may be a valve or the like, may be positioned inn the wellbore tool 15 to control the flow rate of the fluid mixture 5. In such embodiments, differential pressures may be created in the wellbore tool 15 and more specifically in the sampling conduit 20 and sample outflow conduit 35, and these differential pressures may be configured to drive fluids through the wellbore device 15 and more particularly to drive fluids through the sensors and/or into the sampling receptacles. Again, active management of the variable blockage device 240 may provide for active management of the sampling and/or sensing process.

Figure 4:
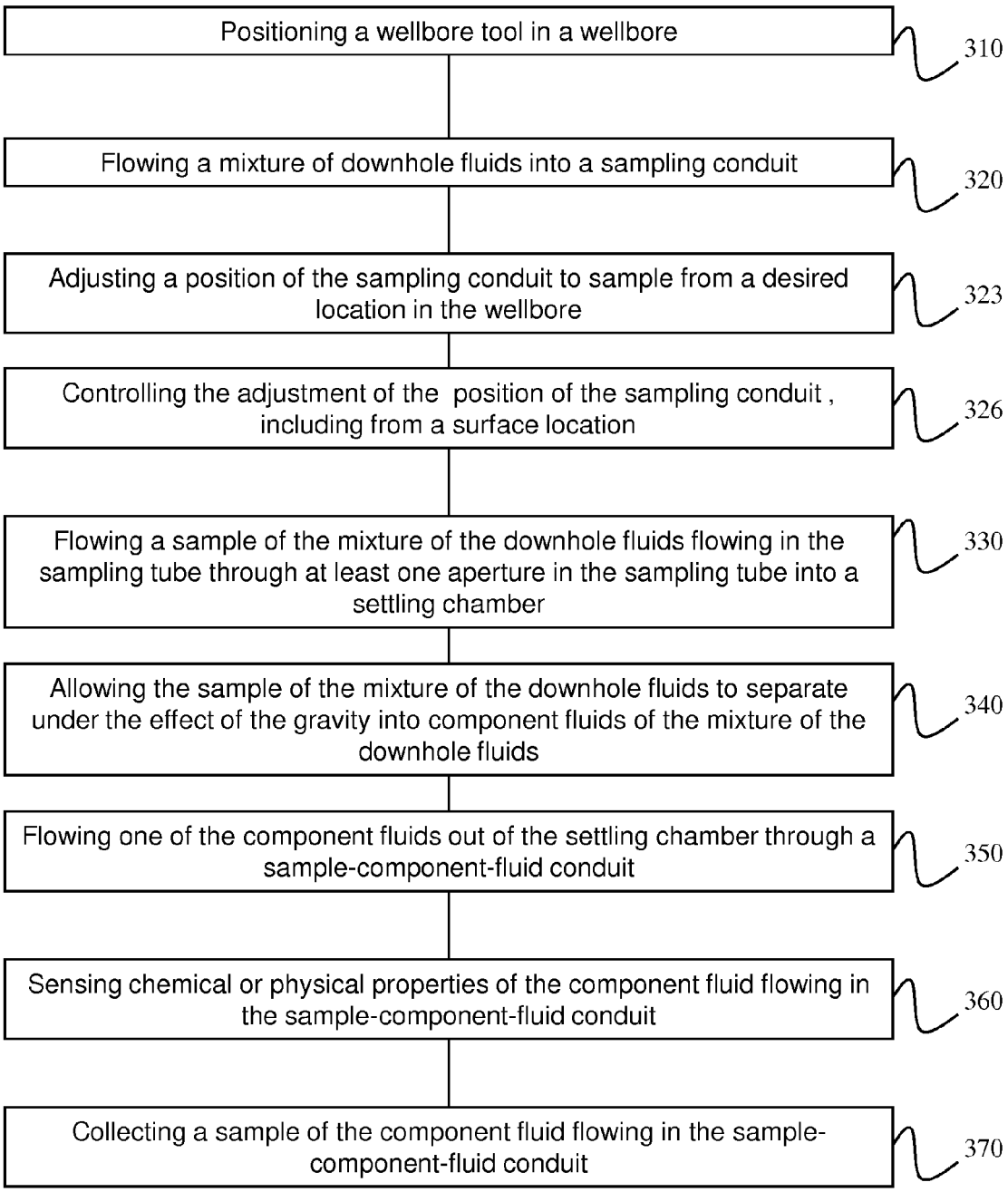
FIG. 4 is a flow-type representation of a process of obtaining clean samples of fluids downhole for withdrawing from the wellbore and/or sensing of physical or chemical properties of the clean sample, in accordance with an embodiment of the present invention.

FIG. 4 is a flow-type representation of a process of obtaining clean samples of fluids downhole for withdrawing from the wellbore and/or sensing of physical or chemical properties of the clean sample, in accordance with an embodiment of the present invention. In step 310, a wellbore tool is deployed down a wellbore. The wellbore tool may comprise a sampling conduit for sampling fluids in the wellbore, a probe for sampling formation fluids of the like.

In the welibore, in step 320 a fluid mixture may be flowed into a sampling conduit of the welibore tool. The flowing of the fluid mixture into the sampling conduit of the wellbore tool may comprise flow of the fluid mixture in the wellbore such as when hydrocarbons are being produced in the wellbore and may be flowing out of the wellbore ads the wellbore tool is being deployed. The flowing of the fluid mixture into the sampling conduit of the wellbore tool may comprise a pump associated with the wellbore tool lowering a pressure in the sampling conduit to provide for flow of the fluid mixture in to the sampling conduit. The flowing of the fluid mixture into the sampling conduit of the wellbore tool may comprise using a pump to withdraw fluids from a formation into the sampling conduit through a probe, guarded probe or the like. The flowing of the fluid mixture into the sampling conduit of the wellbore tool may comprise combinations of the previous examples or similar methods for obtaining downhole sampling of fluids. In step 323, the position of the sampling conduit may be adjusted so that fluids from a certain location in the wellbore are sampled by the sampling conduit. In step 326, the adjustment of the position of the sampling conduit in the wellbore and/or relative to the wellbore tool on which the sampling conduit is located may be controlled. Such control may be performed by a control device located at the surface or the like.

In step 330, all or a portion of the fluid mixture flowing in the sampling conduit may be passed into a settling chamber. To provide for minimization of disturbance of fluid mixture already in the settling chamber, a portion of the fluid mixture flowing in the sampling conduit may be flowed through small apertures into the settling chamber. Flow diverters, buffers, valves and/or the like may also provide for flow of the fluid mixture in the sampling conduit into a settling chamber with minimal disturbance of fluids in the settling chamber.

In step 340, a settling period may be provided to allow for gravitational separation of the fluid mixture into component fluids. This gravitational separation may provide for separation into oil-based and fluid based fluid components or the like. The gravitational separation may also provide for separation of contaminants or non-oil-based or non-water-based fluids from the water based and/or water based component fluids.

In step 350, one or more of the gravitationally separated component fluids may be flowed out of the settling chamber. The step 350, may be selective such that an oil-based component fluid, a water-based component fluid or the like may be selectively flowed out of the settling chamber. The selectivity of the component fluid flowing out of the settling chamber may be achieved by the location of the opening of an outlet conduit in the settling chamber. For example, the opening may be disposed to selectively provide for flow of low density component fluids out of the settling chamber through the outlet conduit.

In step 360, one or more sensors or meters may be used to determine physical and/or chemical properties of the component fluid. Sensors and meters may be protected and may operate with greater effect/accuracy when operating with clean samples of component fluids rather than the original fluid mixture. For example, properties of oil-based fluids may more accurately be determined when water is not present in the sample. In step 370, a sample of the component fluid may be collected for transfer to the surface, downhole experimentation or the like.

In the foregoing description, for the purposes of illustration, various methods and/or procedures were described in a particular order. It should be appreciated that in alternate embodiments, the methods and/or procedures may be performed in an order different than that described. It should also be appreciated that the methods described above may be performed by hardware components and/or may be embodied in sequences of machine-executable instructions, which may be used to cause a machine, such as a general-purpose or special-purpose processor or logic circuits programmed with the instructions, to perform the methods. These machine-executable instructions may be stored on one or more machine readable media, such as CD-ROMs or other type of optical disks, floppy diskettes, ROMs, RAMs, EPROMs, EEPROMs, magnetic or optical cards, flash memory, or other types of machine-readable media suitable for storing electronic instructions. Merely by way of example, some embodiments of the invention provide software programs, which may be executed on one or more computers, for performing the methods and/or procedures described above. In particular embodiments, for example, there may be a plurality of software components configured to execute on various hardware devices. Alternatively, the methods may be performed by a combination of hardware and software.

Hence, while detailed descriptions of one or more embodiments of the invention have been given above, various alternatives, modifications, and equivalents will be apparent to those skilled in the art without varying from the spirit of the invention. Moreover, except where clearly inappropriate or otherwise expressly noted, it should be assumed that the features, devices and/or components of different embodiments can be substituted and/or combined. Thus, the above description should not be taken as limiting the scope of the invention, which is defined by the appended claims.

The invention claimed is:

1. A system for obtaining clean samples of downhole fluids in a wellbore, comprising:

a wellbore tool configured for disposal within the wellbore;

a sampling conduit coupled with the wellbore tool and configured to provide a flow path for a sample of the downhole fluids, wherein the sampling conduit comprises one or more apertures in a sidewall of the sampling conduit, and wherein the sampling conduit is continuously adjustable to provide for sampling of the downhole fluids from a selected location across a diameter of the wellbore when the wellbore tool moves within the wellbore:

a settling chamber coupled with the sampling conduit and configured to provide that at least a part of the sample of the downhole fluids flowing in the sampling conduit flows through the one or more apertures and into the settling chamber, wherein the settling chamber is configured to provide for gravitational separation of the downhole fluids contained within the separation chamber; and a first sample outlet conduit coupled with the settling chamber and configured to provide for flowing one of the separated downhole fluids out of said settling chamber.

2. The system of claim 1, wherein the downhole fluids comprise a water-based fluid and an oil-based fluid, and wherein the water-based fluid and the oil-based-fluid are gravitationally separated in the settling chamber.

3. The system of claim 2, wherein the first sample outlet conduit is configured to provide for selective flow of the water-based fluid out of the settling chamber through the first sample outlet conduit.

4. The system of claim 2, wherein the first sample outlet conduit is configured to provide for selective flow of the oil-based fluid out of the settling chamber through the first sample outlet conduit.

5. The system of claim 1, further comprising a first sample receptacle coupled with the first sample outlet conduit and configured to collect a first sample of a liquid flowing through the first sample outlet conduit.

6. The apparatus of claim 5, wherein the downhole fluids comprise a water-based fluid and an oil-based fluid and the oil-based fluid selectively flows through the first sample outlet conduit and the water-based fluid selectively flows through the second sample outlet conduit.

7. The system of claim 1, further comprising a first sensor coupled with the first sample outlet conduit and configured to sense a chemical or a physical property of a fluid flowing through the first sample outlet conduit.

8. The system of claim 1, further comprising:

a second sample outlet coupled with the settling chamber, wherein:

the first sample outlet conduit is coupled with the settling chamber at a first location;

the second sample outlet conduit is coupled with the settling chamber at a second location; and the first location is disposed above the second location to provide that constituent fluids with low densities selectively flow through the first sample outlet conduit.

9. The system of claim 8, further comprising:

a first sample receptacle coupled with the first sample outlet conduit and configured to collect a first sample of a liquid flowing through the first sample outlet conduit.

10. The system of claim 8, further comprising:

a second sample receptacle coupled with the second sample outlet conduit and configured to collect a second sample of a liquid flowing through the first sample outlet conduit.

11. The system of claim 1, wherein the sampling conduit is controlled from a surface location.

12. The system of claim 1, wherein the first sample outlet conduit is adjustable and configured to provide for selectively flowing one or more of the separated downhole fluids out of the settling chamber through the first sample outlet conduit.

13. The system of claim 12, wherein the first sample outlet conduit is continuously adjustable to provide that the same one or more of the separated downhole fluids flows out of the settling chamber through the first sample outlet conduit when the wellbore tool moves within the wellbore.

14. The system of claim 12, wherein the first sample outlet conduit is controlled from a surface location.

15. The system of claim 1, wherein the one or more apertures are configured to cause minimal disturbance to the part of the sample of the downhole fluids in the settling chamber.

16. The system of claim 15, wherein the one or more apertures have dimensions of the order of millimeters.

17. A method for collecting a clean sample of a first fluid from a mixture comprising at least the first fluid and a second fluid, comprising the following steps:

deploying a wellbore tool down a wellbore;

flowing the mixture into a sampling conduit of the wellbore tool;

flowing a portion of the mixture in the sampling conduit into a settling chamber;

allowing the mixture to separate under gravitational effects into the first fluid and the second fluid;

flowing the separated first fluid out of the settling chamber;

adjusting a position of an outlet conduit through which the separated first fluid flows out of the settling chamber in response to movement of the wellbore tool within the wellbore; and collecting a sample of the first fluid.

18. The method of claim 17, wherein the first fluid is water-based and the second fluid is oil-based.

19. The method of claim 17, wherein flowing the mixture into a sampling conduit of the wellbore tool comprises withdrawing the mixture from an earth formation into the sampling conduit.

* * * * *